US009169733B2

(12) United States Patent
Kerber et al.

(10) Patent No.: US 9,169,733 B2
(45) Date of Patent: Oct. 27, 2015

(54) TURBINE AIRFOIL ASSEMBLY

(71) Applicant: General Electric Company, Schenectady, NY (US)

(72) Inventors: Onika Misasha Kerber, Gray Court, SC (US); Gary Michael Itzel, Simpsonville, SC (US); James William Vehr, Easley, SC (US); Evan Andrew Sewall, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 478 days.

(21) Appl. No.: 13/847,839

(22) Filed: Mar. 20, 2013

(65) Prior Publication Data

US 2014/0286762 A1 Sep. 25, 2014

(51) Int. Cl.

| | |
|---|---|
| ***B63H 1/14*** | (2006.01) |
| ***B63H 7/02*** | (2006.01) |
| ***F01D 5/18*** | (2006.01) |

(52) U.S. Cl.

CPC ..... *F01D 5/188* (2013.01); *F01D 5/189* (2013.01); *F05D 2240/303* (2013.01); *F05D 2260/201* (2013.01)

(58) Field of Classification Search

CPC ... F01D 5/188; F01D 5/189; F05D 2240/303; F05D 2260/201

USPC .... 416/96 R, 96 A, 97 R, 97 A; 415/115, 116

See application file for complete search history.

(56) References Cited

U.S. PATENT DOCUMENTS

| | | | | |
|---|---|---|---|---|
| 3,963,368 | A | 6/1976 | Emmerson | |
| 4,403,917 | A * | 9/1983 | Laffitte | F01D 5/188 415/115 |
| 4,461,612 | A * | 7/1984 | Dodd | F01D 5/186 415/115 |
| 5,741,117 | A | 4/1998 | Clevenger | |
| 6,468,031 | B1 * | 10/2002 | Yu et al. | F01D 5/189 415/114 |
| 6,733,229 | B2 | 5/2004 | Burdgick et al. | |
| 7,497,655 | B1 * | 3/2009 | Liang | F01D 5/189 415/1 |
| 7,556,476 | B1 | 7/2009 | Liang | |
| 2006/0056968 | A1 | 3/2006 | Jacala et al. | |
| 2009/0087312 | A1 | 4/2009 | Bunker et al. | |
| 2010/0221123 | A1 | 9/2010 | Pal et al. | |
| 2011/0027102 | A1 * | 2/2011 | Nakamata | F01D 5/186 416/97 R |

* cited by examiner

*Primary Examiner* — Hoang Nguyen

(74) *Attorney, Agent, or Firm* — James W. Pemrick; Ernest G. Cusick; Frank A. Landgraff

(57) ABSTRACT

A turbine airfoil assembly has an airfoil with an inner wall, an outer wall, a leading edge and a trailing edge. The airfoil has one or more chambers extending in a substantially chordwise direction of the airfoil. An insert has a plurality of impingement holes, and the insert is configured to be inserted within one of the chambers. The insert is configured to cool the airfoil via the plurality of impingement holes. A chambering element is attached only to the insert, the chambering element is configured to provide an increased cooling gas pressure inside a boundary area defined by the chambering element relative to an area outside the boundary area. A gap exists between the inner wall of the airfoil and the chambering element, and the gap allows cooling gas to exit the boundary area and enter the area outside the boundary area.

20 Claims, 4 Drawing Sheets

TURBINE AIRFOIL ASSEMBLY

BACKGROUND OF THE INVENTION

The invention described herein relates generally to a turbine airfoil assembly. More specifically, the invention relates to a turbine airfoil assembly configured for improved cooling performance.

Turbine airfoil assemblies direct gaseous flow passing through rotor assemblies within a gas turbine. For example, a stator vane assembly may include one or more stator vane airfoils extending radially between an inner and an outer platform. The temperature of core gas flow passing the stator vane airfoil typically requires cooling within the stator vane, and this cooling helps to increase stator vane life.

In many gas turbines, some components must be cooled to extend operating life. Cooling air at a lower temperature and higher pressure than the core gas is typically introduced into an internal cavity of a stator vane, where it absorbs thermal energy. The cooling air subsequently exits the vane via apertures in the vane walls, transporting the thermal energy away from the vane. The pressure difference across the vane walls and the flow rate at which the cooling air exits the vane is important, particularly along the leading edge where temperatures may be elevated. In the past, internal vane structures have been defined by first establishing the minimum acceptable pressure difference at any point along the leading edge (internal versus external pressure), and subsequently manipulating the internal vane structure along the entire leading edge such that the minimal allowable pressure difference is present along the entire leading edge. The problem with this approach is that core gas flow pressure gradients along the leading edge of a vane may have one or more small regions (i.e., "spikes") at a pressure considerably higher than the rest of the gradient along the leading edge. This is particularly true for those stator vanes disposed aft of rotor assemblies, where relative motion between rotor blades and stator vanes can significantly influence the core gas flow profile. Increasing the minimum allowable pressure to accommodate the spikes consumes an excessive amount of cooling air.

Prior approaches have modified the internal vane structure, but this approach does not permit customization. Turbines may be installed in a wide variety of locations (e.g., hot, cold, dry, humid, etc.) and the same turbine in a very cold and humid environment may experience a very different core gas flow pressure gradient than a turbine installed in a hot and dry environment.

BRIEF DESCRIPTION OF THE INVENTION

In an aspect of the present invention, a turbine airfoil assembly has an airfoil with an inner wall, an outer wall, a leading edge and a trailing edge. The airfoil has one or more chambers extending in a substantially chordwise direction of the airfoil. An insert has a plurality of impingement holes, and the insert is configured to be inserted within one of the chambers. The insert is configured to cool the airfoil via the plurality of impingement holes. A chambering element is attached only to the insert, the chambering element is configured to provide an increased cooling gas pressure inside a boundary area defined by the chambering element relative to an area outside the boundary area. A gap exists between the inner wall of the airfoil and the chambering element, and the gap allows cooling gas to exit the boundary area and enter the area outside the boundary area.

In another aspect of the present invention, a turbine airfoil assembly has an airfoil with an inner wall. The airfoil has one or more chambers extending in a substantially chordwise direction of the airfoil. An insert includes a plurality of impingement holes, and the insert is configured to be inserted within one of the chambers. The insert is configured to cool the airfoil via the plurality of impingement holes. A chambering element is attached only to the insert or only to the airfoil. The chambering element is configured to provide an increased cooling gas pressure inside a boundary area defined by the chambering element relative to an area outside the boundary area. A gap exists between the chambering element and the inner wall of the airfoil or the insert. The gap allows cooling gas to exit the boundary area and enter the area outside the boundary area.

DETAILED DESCRIPTION OF THE INVENTION

One or more specific aspects/embodiments of the present invention will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features.

Figure 1:
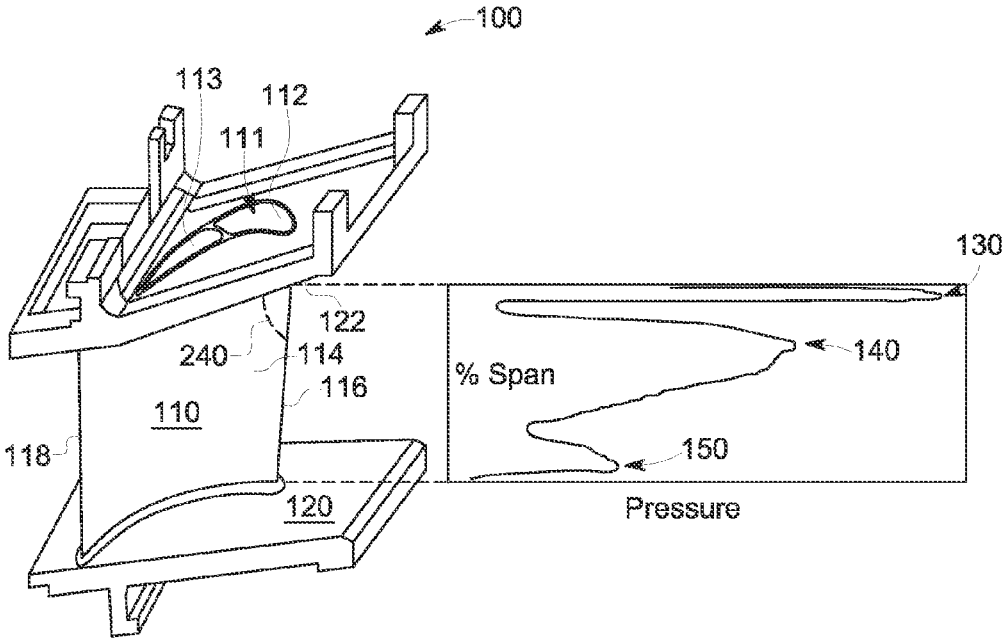
FIG. 1 illustrates an isometric view of a turbine airfoil assembly, according to an aspect of the present invention.

FIG. 1 illustrates an isometric view of a turbine airfoil assembly 100 and a chart showing pressure vs. percent span in example scenario, according to an aspect of the present invention. The turbine airfoil assembly 100 includes an airfoil 110 having an inner wall 112, an outer wall 114, a leading edge 116 and a trailing edge 118. Core gas generally travels from the leading edge to the trailing edge, or generally right to left in FIG. 1. The airfoil 110 also includes one or more chambers 111, 113 extending in a substantially chordwise direction of airfoil 110. In this example, the turbine airfoil assembly 100 may be a stator nozzle in a gas turbine. The airfoil 110 extends between a radially inner platform 120 and a radially outer platform 122.

The chambers 111, 113 may be configured to accept an insert (not shown in FIG. 1) that is used to cool the airfoil 110. As stated previously, the core gas passing by the turbine airfoil assembly 100 is at elevated temperatures and the temperatures may vary across the span of the airfoil. For example, the percent span (Y-axis) refers to the height of the airfoil and the pressure (X-axis) is the pressure of the core gas along various span positions (or heights) of the airfoil. A zero percent span would refer to the bottom of the airfoil (near platform 120), and a 100 percent span would refer to the top of the airfoil (near platform 122). Due to various operating conditions, the pressure can vary significantly across the span of the airfoil. In the example shown, the pressure has a first spike 130 near the top of the airfoil, a second lower spike 140 at about the 70% span region and a third much lower spike 150 near the bottom of the airfoil.

Figure 2:
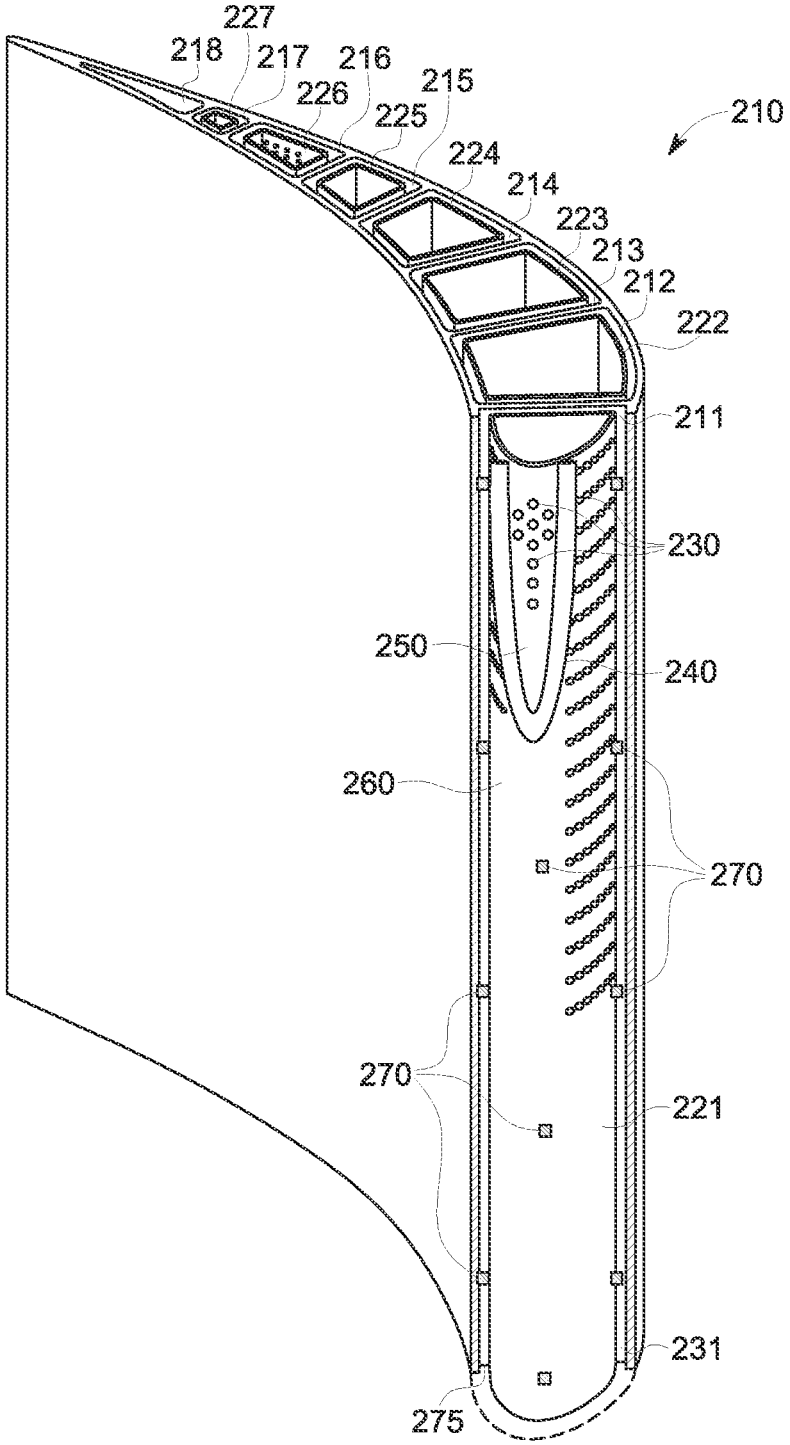
FIG. 2 illustrates a schematic, broken away perspective view of an airfoil, according to an aspect of the present invention.

FIG. 2 illustrates a schematic, broken away perspective view of an airfoil 210, according to an aspect of the present invention. The airfoil 210 has multiple chambers 211, 212, 213, 214, 215, 216, 217, 218 and some of these chambers may have inserts 221, 222, 223, 224, 225, 226, 227. The inserts are configured to be inserted within the chambers. For example, insert 221 is sized to be inserted within chamber 211. Some or all of the inserts will have an array of impingement holes for cooling the airfoil. For example, the leading edge insert 221 has a plurality of impingement holes 230. Cooling air (e.g., from a compressor in a gas turbine application) is forced into the interior of the insert and then passes out the impingement holes 230 and impacts (or impinges on) the inner wall 231 of chamber 211 (or airfoil 210).

To counteract regions of high core gas pressure, a chambering element 240 is attached to the insert 221 and is configured to provide an increased cooling gas pressure inside the boundary area 250 defined by the chambering element 240 relative to an area 260 outside the boundary area 250. The boundary area 250 is the region of space inside the chambering element border, and the area 260 is the region of space external to the boundary area 250. The increased internal pressure in boundary area 250 may also help if a crack occurred in the airfoil wall, in the location of high external pressures, because the hot core gas will not be ingested through the crack (due to the increased internal pressure) which may cause a structural failure of the airfoil. The chambering element 240 may be comprised of a wire, or physical member that partially isolates the inner region 250 from the outer region 260. The chambering element 240 may be attached to the insert 221 by welding, brazing, a mechanical connection or by adhesive.

A gap 275 exists between the inner wall 231 and the insert 221. Post impingement cooling gas travels along this gap and then exits the airfoil 210. A plurality of standoffs 270 may be configured to maintain this gap. The standoffs are attached to the insert 221 (e.g., by welding) or cast into the inner wall 231 and have a predetermined height and/or spacing. For example, the desired gap may be 2 mm, so the height of one or more standoffs 221 may be about 2 mm.

Figure 3:
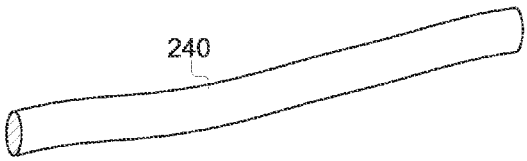
FIG. 3 illustrates a partial perspective view of the chambering element, according to an aspect of the present invention.
Figure 4:
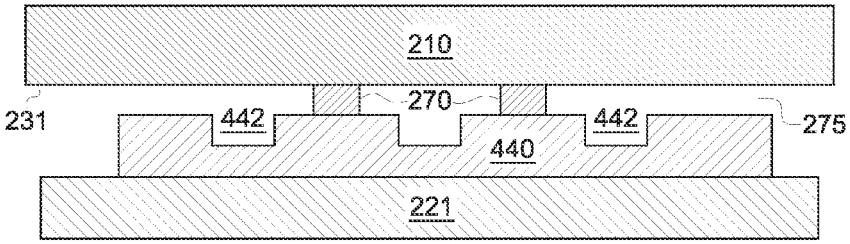
FIG. 4 illustrates a cross-sectional view of a chambering element, according to an aspect of the present invention.
Figure 5:
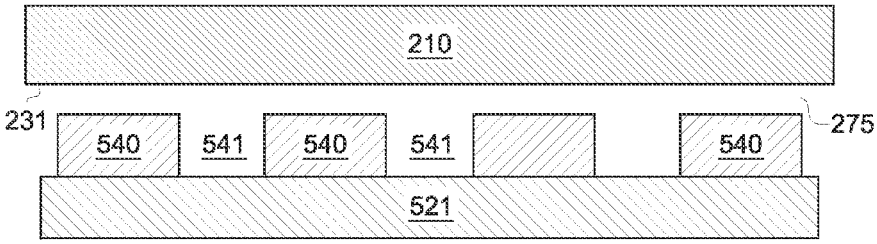
FIG. 5 illustrates a cross-sectional view of a chambering element, according to an aspect of the present invention.
Figure 6:
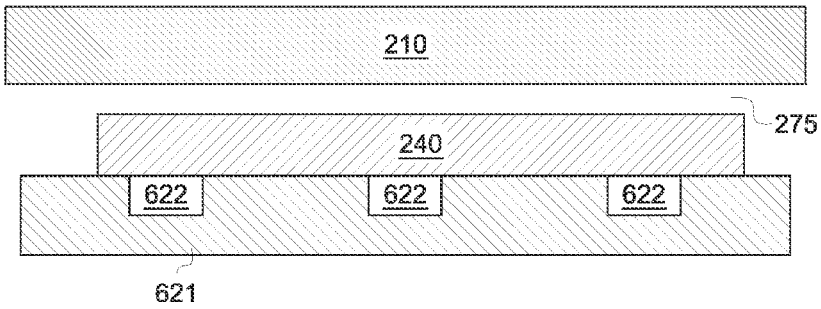
FIG. 6 illustrates a cross-sectional view of the chambering element attached to a liner, according to an aspect of the present invention.

FIG. 3 illustrates a partial perspective view of the chambering element 240. In this example, the chambering element 240 is a substantially solid member having a substantially constant cross-sectional area (e.g., a wire). FIG. 4 illustrates a partial cross-sectional view of a chambering element 440 that is a substantially solid member having notched portions 442 to facilitate escape of cooling gas. The chambering element 440 is attached to insert 221. A gap 275 exists between the airfoil 210 inner wall 231 and the top of chambering element 440. FIG. 5 illustrates a partial cross-sectional view of a chambering element 540 that is a segmented member having spaces 541 between adjacent sections, and the spaces 541 facilitate escape of the cooling gas. FIG. 6 illustrates a partial cross-sectional view of a chambering element 240 that is attached to the insert 621. The insert 621 includes a plurality of channels 622 configured to pass beneath the chambering element 240, and the channels 622 are configured to facilitate escape of the cooling gas.

Figure 7:
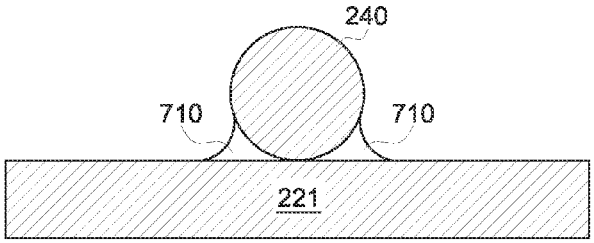
FIG. 7 illustrates a cross-sectional view of the chambering element attached to the insert via a weld or braze, according to an aspect of the present invention.

FIG. 7 illustrates a cross-sectional view of the chambering element and insert connection. The chambering element 240 may be attached to the insert 221 by a weld 710. Weld 710 could also be a braze. The weld 710 could be formed over all or a portion of the chambering element 240/insert 221 interface. Alternatively, weld 710 could be substituted by a mechanical connection (e.g., where the chambering element is attached to a sleeve that fits over all or a portion of the insert), or an adhesive connection assuming that the adhesive used could withstand the operating conditions of the turbine. The chambering element 240 could also be formed in the insert due to a local extrusion of the insert wall.

Figure 8:
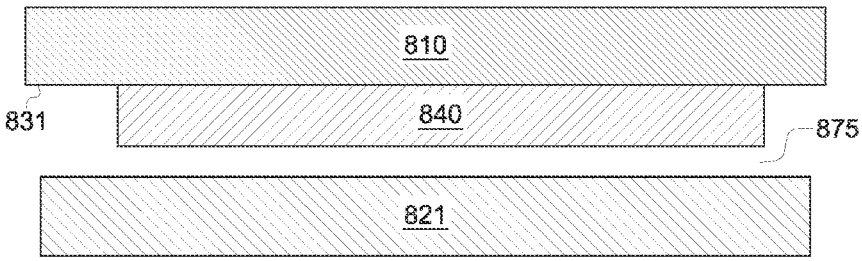
FIG. 8 illustrates a cross-sectional view of the chambering element attached to an airfoil, according to an aspect of the present invention.

FIG. 8 illustrates a cross-sectional view of the chambering element 840 and airfoil 810 connection. The chambering element 840 may be attached only to the inner wall 831 of airfoil 810 by a weld or braze. The weld could be formed over all or a portion of the chambering element 840/airfoil 810 interface. Alternatively, the chambering element 840 could be attached to the airfoil 810 by a mechanical connection or an adhesive connection assuming that the adhesive used could withstand the operating conditions of the turbine. The chambering element 840 could also be formed in the airfoil 840 due to a local extrusion of the insert wall or by casting. A gap 875 exists between the chambering element 840 and the insert 821. Post impingement cooling gas travels along this gap and then exits the airfoil. A plurality of standoffs (not shown in FIG. 8) may be configured to maintain this gap. The standoffs may be attached to the insert 821, inner wall 831/airfoil 810 or chambering element 840, and have a predetermined height and/or spacing.

The turbine airfoil assembly 100, according to an aspect of the present invention, could be configured for use as a bucket, blade, nozzle, a shroud or vane in a gas turbine, steam turbine, or any other turbomachinery component that requires cooling. As mentioned previously, gas turbines and steam turbines (or any other turbomachine or turbo-engine) operate in widely varying environmental conditions and the fuel used may also vary greatly. It would be highly beneficial to be able to "customize" each turbine to its individual operating and environmental conditions, and this was not possible in the past. The present invention now enables the turbomachine to be quickly customized or repaired so that any problem areas (e.g., hot spots on airfoils) can be configured so that additional cooling gas can be directed and maintained in the areas that need it most.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine airfoil assembly comprising:

an airfoil having an inner wall, an outer wall, a leading edge and a trailing edge, the airfoil having one or more chambers extending in a substantially chordwise direction of the airfoil;

an insert having a plurality of impingement holes, the insert configured to be inserted within one of the chambers, wherein the insert is configured to cool the airfoil via the plurality of impingement holes;

wherein a chambering element is attached only to the insert, the chambering element is configured to provide an increased cooling gas pressure inside a boundary area defined by the chambering element relative to an area outside the boundary area, and wherein a gap exists between the inner wall of the airfoil and the chambering element, the gap allowing a cooling gas to exit the boundary area and enter the area outside the boundary area.

2. The turbine airfoil assembly of claim 1, wherein the chambering element is attached to the insert via a weld.

3. The turbine airfoil assembly of claim 1, wherein the chambering element is attached to the insert via at least one of:

a mechanical connection, an adhesive connection or a local extrusion of the insert wall.

4. The turbine airfoil assembly of claim 1, wherein the chambering element is a substantially solid member having a substantially constant cross-sectional area.

5. The turbine airfoil assembly of claim 1, wherein the chambering element is a substantially solid member having notched portions to facilitate escape of the cooling gas.

6. The turbine airfoil assembly of claim 1, wherein the chambering element is a segmented member having spaces between adjacent sections, the spaces facilitating escape of the cooling gas.

7. The turbine airfoil assembly of claim 1, wherein the insert comprises a plurality of channels configured to pass beneath the chambering element, the plurality of channels configured to facilitate escape of the cooling gas.

8. The turbine airfoil assembly of claim 1, wherein the turbine airfoil assembly is configured for use in at least one of, a gas turbine, a steam turbine or a compressor.

9. The turbine airfoil assembly of claim 1, wherein the turbine airfoil assembly is configured for use as at least one of a bucket, a blade, a nozzle, a shroud and a vane, and wherein the turbine airfoil assembly is configured for use in at least one of, a gas turbine, a steam turbine or a compressor.

10. The turbine airfoil assembly of claim 1, further comprising a plurality of standoffs attached to the insert, the plurality of standoffs configured to maintain a gap between the insert and the inner wall of the airfoil.

11. A turbine airfoil assembly comprising:

an airfoil having an inner wall, the airfoil having one or more chambers extending in a substantially chordwise direction of the airfoil;

an insert having a plurality of impingement holes, the insert configured to be inserted within one of the chambers, wherein the insert is configured to cool the airfoil via the plurality of impingement holes;

wherein a chambering element is attached only to the insert or only to the airfoil, the chambering element is configured to provide an increased cooling gas pressure inside a boundary area defined by the chambering element relative to an area outside the boundary area, and wherein a gap exists between the chambering element and at least one of the inner wall of the airfoil or the insert, the gap allowing a cooling gas to exit the boundary area and enter the area outside the boundary area.

12. The turbine airfoil assembly of claim 11, wherein the chambering element is attached to the insert or the airfoil via a weld.

13. The turbine airfoil assembly of claim 11, wherein the chambering element is attached to the insert or the airfoil via at least one of:

a mechanical connection, an adhesive connection, a local extrusion of the insert wall or by casting.

14. The turbine airfoil assembly of claim 11, wherein the chambering element is a substantially solid member having a substantially constant cross-sectional area.

15. The turbine airfoil assembly of claim 11, wherein the chambering element is a substantially solid member having notched portions to facilitate escape of the cooling gas.

16. The turbine airfoil assembly of claim 11, wherein the chambering element is a segmented member having spaces between adjacent sections, the spaces facilitating escape of the cooling gas.

17. The turbine airfoil assembly of claim 11, wherein the insert comprises a plurality of channels configured to pass beneath the chambering element, the plurality of channels configured to facilitate escape of the cooling gas.

18. The turbine airfoil assembly of claim 11, wherein the turbine airfoil assembly is configured for use in at least one of, a gas turbine, a steam turbine or a compressor.

19. The turbine airfoil assembly of claim 11, wherein the turbine airfoil assembly is configured for use as at least one of a bucket, a blade, a nozzle, a shroud and a vane, and wherein the turbine airfoil assembly is configured for use in at least one of, a gas turbine, a steam turbine or a compressor.

20. The turbine airfoil assembly of claim 11, further comprising a plurality of standoffs attached to the insert or the airfoil, the plurality of standoffs configured to maintain a gap between the insert and the inner wall of the airfoil.

* * * * *